United States Patent [19]

Hoffmann et al.

[11] 4,436,362

[45] Mar. 13, 1984

[54] CONNECTOR FOR PRINTED CIRCUIT BOARDS

[75] Inventors: Richard Hoffmann; Franz Zobawa, both of Munich, Fed. Rep. of Germany

[73] Assignee: Siemens Aktiengesellschaft, Berlin & Munich

[21] Appl. No.: 326,708

[22] Filed: Dec. 2, 1981

[30] Foreign Application Priority Data

Feb. 2, 1981 [DE] Fed. Rep. of Germany ..... 3103455

[51] Int. Cl.[3] ..... H01R 13/58

[52] U.S. Cl. ..... 339/103 M

[58] Field of Search ..... 339/103 R, 103 M, 105, 339/107

[56] References Cited

U.S. PATENT DOCUMENTS 4,111,512 9/1978 Parmer et al. ..... 339/103 M X 4,341,431 7/1982 Woratyla ..... 339/103 M

*Primary Examiner*—Eugene F. Desmond

*Attorney, Agent, or Firm*—Hill, Van Santen, Steadman & Simpson

[57] ABSTRACT

A connecting plug for printed circuit boards has a receiving part with a front cross bar having rectangular openings therein surrounded by insertion bevels and corresponding to the necessary contact count. A multiple contact strip containing contacts snaps into the receiving part. Contact insertion and a decrease in assembly is thereby facilitated. The connecting plug is suitable, in particular, for use in devices of data systems.

10 Claims, 2 Drawing Figures

CONNECTOR FOR PRINTED CIRCUIT BOARDS

BACKGROUND OF THE INVENTION

1. Field of the Invention

The present invention relates to connectors, and in particular to a connecting plug for printed circuit boards such as may be used in data systems engineering.

2. Description of the Prior Art

Conventional connecting plugs for printed circuit boards, in particular for data systems engineering, have the disadvantage that they comprise several parts which must be glued together. Thereby, the connecting plug essentially comprises a receiving part and a multiple contact strip which is glued thereto. Since during the gluing, the two arms of the receiving part are pressed against the multiple contact strip, during the use of the multiple contact strip, a relatively large amount of play results in their counterparts. If the connecting plug, during the plugging-in or plugging-out is twisted, the contact pins of the pin bar become bent. In addition, such plugs, for the sake of simplification of the extrusion die, have no type of insertion bevels. This sometimes leads, during the plugging-in of the connecting plug with respect to bent pins, to misinsertions and, thus, to sporadic defects in operation.

A further disadvantage of such connecting plugs is the poor insertion capacity of the plug with the contact springs clamped onto cables. Particular difficulty is caused by so-called 50 ohm four-part lines because the individual four parts are supposed to remain stranded together up to the multiple contact strip housing. If one glues the multiple contact strip and receiving part together before the insertion, then it is very time-consuming to plug the contact springs into the specified changes. If the gluing takes place after insertion of the multiple contact strip, then the manipulation through the attached line is complicated. In addition, contact damages occur due to adhesive remainders, adhesive vapors, etc.

SUMMARY OF THE INVENTION

The object of the present invention is to provide a connecting plug for printed circuit boards which is easily manufactured and easily mounted.

According to the invention, the connecting plug is designed such that it comprises a receiving part and a multiple contact strip which can snap into the receiving part. The receiving part comprises a floor which is enclosed on three sides by sidewalls which extend perpendicular thereto and a front cross bar. The cross bar comprises rectangular openings corresponding to the number of connection contacts, arranged in rows and provided with insertion bevels. The two sidewalls are provided with a respective opening, to which introduction guide tracks for detents extend, which openings are beveled from the rear. The floor part, in a portion which projects out over the sidewalls comprises means for traction relief and openings for cable clamps, as well as locking shoulders for the application of a protective cap. The multiple contact strip comprises a parallelopiped-shaped portion in which rectangular contact chambers corresponding to the number of connection contacts are arranged such that during the insertion of the multiple contact strip into the receiving part, the same come to rest directly behind the openings of the cross bar. On the sidewalls of the multiple contact strip, detents are provided for engagement into the openings of the receiving part.

By means of the aforementioned measures, one obtains a connecting plug whose individual parts can be snapped in, whereby gluing can be entirely eliminated. With such a structure, the manufacture is simplified, which leads to a more economical product. In addition, the manipulation is more simple.

The loose multiple contact strip can thereby be lined up before assembly with contact springs and only then be brought together with the receiving part.

With the insertion bevels provided for the contact pins, a significant misinsertion safety is attained.

For the reinforcement of the connecting plug, a further embodiment provides that the multiple contact strip, upon its front upper and lower side, has step-shaped shoulders, into which shoulders reinforcement ribs engage, which ribs extend over the cross bar. In order to obtain an enclosed embodiment of the pin, a covering cap designed in U-shaped, which is equipped with locking hooks on its two U-shaped arms, is provided, which is snapable laterally into recesses of the rear floor portion.

In the case of jacketed round types of cables, the strain relief can be carried out in that the strain relief structure can comprise longitudinal grooves in the rear floor portion.

In all remaining cases, in addition to the grooves provided, also a strain relief is possible with a half shell-shaped support frame which can be inserted on the rear floor portion in locking grooves for security against rotation.

The openings for the cable clamps are thereby attached in pairs opposite the grooves so that the line feed can be undertaken in the plugging direction, as well as at an angle of 90° thereto, which is only possible by the displacement of the support frame in each case.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
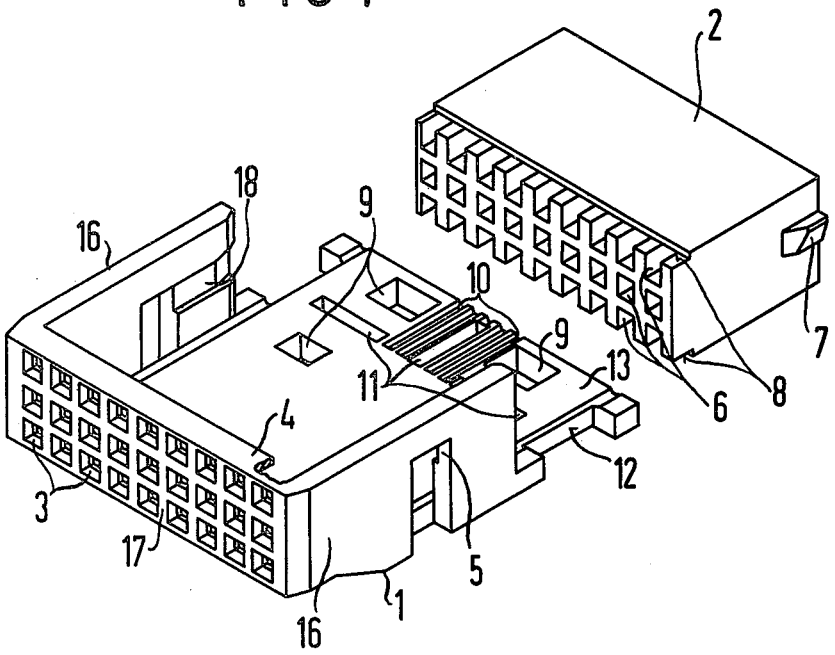
FIG. 1 illustrates the receiving part and the multiple contact strip in a non-locked state.

Referring to FIG. 1, a 27 terminal connecting plug is illustrated; however, any other terminal count can be generated. The receiving part 1 comprises a floor part 13, as well as a pair of sidewalls 16 and a cross bar 4. The cross bar 4 has three rows of rectangular plug openings 3 which, in each case, are provided with insertion bevels. Each sidewall 16 includes an opening 5 which receives guide tracks 18, which are beveled at the leading edges. The floor part 13 projects beyond the two sidewalls 16 and in this projecting part, longitudinal grooves 10 are provided for strain relief if no support frame 14 (FIG. 2) is required. The longitudinal grooves 10 can thereby be provided in a trough-shaped indentation for better security against twisting of the cable. Also in this part, openings 9 for the cable clamps are provided. On the sides, the projecting part contains locking shoulders 12 for receiving a covering cap 15 (FIG. 2).

The multiple contact strip 2 comprises a parallelopiped portion which contains three rows of contact chambers 6 which, after snapping into the receiving part 1, come to rest directly beyond the plug openings 3. On the narrow sides of the multiple contact strip 2, detents 7 are provided which, in the case of insertion into the receiving part, are guided in the guide tracks 18 until the same snap into the openings 5.

Before snapping of the multiple contact strip 2 into the floor part 1 occurs, the contact springs fastened to the feed wires are inserted from the rear into the multiple contact strip, whereby the assembly is significantly facilitated. Only after insertion of the contact springs is the multiple contact strip snapped into the receiving part 1.

Figure 2:
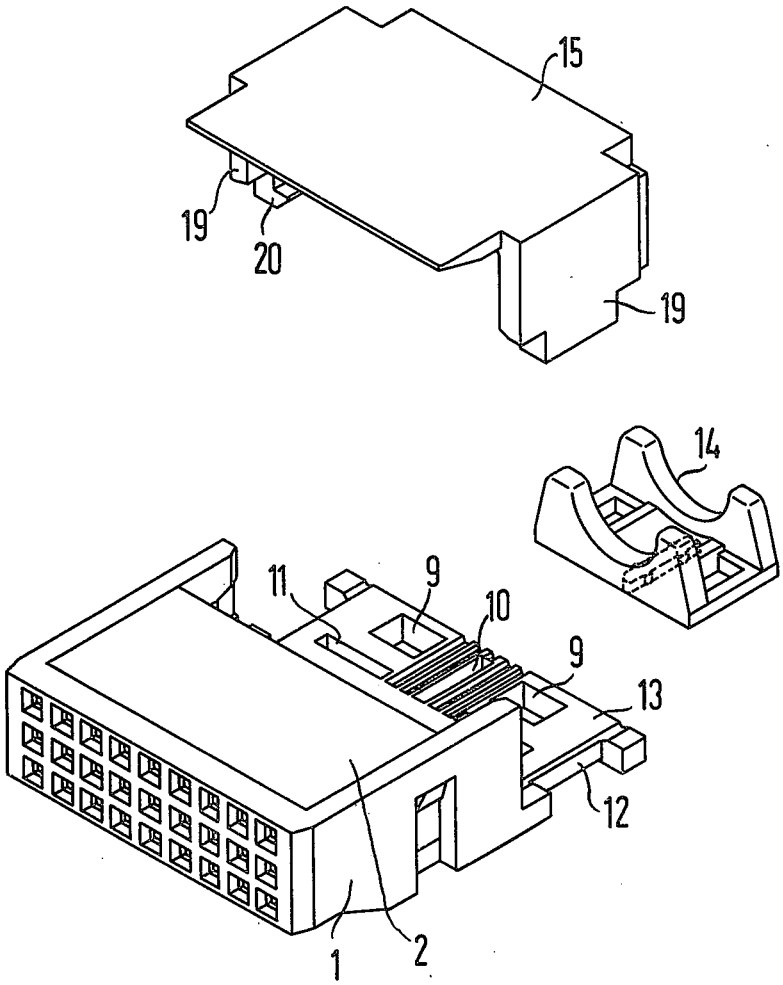
FIG. 2 illustrates the receiving part and the multiple contact strip in the lock state, as well as the support frame and a covering cap in a exploded view.

In FIG. 2, the state of the receiving part and the multiple contact strip 2 is illustrated after the same have already been snapped together. Additionally, a support frame 14, which is designed in a half shell shape is illustrated, the support frame being provided for effecting strain relief for such lines as would not be sufficiently provided by the grooves 10. In order to obtain an encased embodiment of the connecting plug, a cap 15, designed U-shaped, can snap onto the rear part of the floor 13, whereby the arms of the cap have locking hooks 20 which extend inwardly for engagement with the shoulders 12 of the rear floor part 13 and bear against the floor part from the underside. The support frame can also contain longitudinal grooves for better safety against twisting of the cable. The slot in the rear floor part of the connecting plug is designed insulator-shaped and the plastic jacket of the cable can be braced very well therein, whereby the pulling force for the cable can be significantly increased.

Although we have described our invention with respect to particular embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A connecting plug comprising:

a rectangular parallelopiped contact strip including a front face and a plurality of elongate rectangular chambers therein for supporting a plurality of contacts in a predetermined pattern, and a pair of oppositely-directed detents; and a receiving part including a front cross bar having a front face, a rear face and a plurality of beveled openings therethrough in the same pattern as and for alignment with said chambers, a floor extending rearwardly from said front cross bar and including a rear section, strain relief grooves in said rear section and a pair of openings on respective sides adjacent said rear face of said front cross bar, said side walls including respective openings for snap-in retention of said oppositely-directed detents and respective guide tracks for said detents extending from the rear ends of said side walls to said openings.

2. A connecting plug comprising:

a multiple contact strip including a plurality of chambers for supporting a plurality of contacts in a predetermined pattern, and including a pair of oppositely-directed detents;

a receiving part including a front cross bar having a plurality of beveled openings therethrough in the same pattern as and for alignment with said chambers, a floor extending rearwardly from said front cross bar, and a pair of sidewalls extending rearwardly from said front cross bar and upwardly from said floor, whereby said front cross bar, said floor and said sidewalls form a cavity for receiving said contact strip, said sidewalls including respective openings for snap-in retention of said oppositely-directed detents;

said front cross bar comprising first and second rearwardly-extending bracing ribs; and said multiple contact strip comprising means defining a pair of recesses for receiving said ribs.

3. A connecting plug comprising:

a first part including a floor having a front portion and a rear portion, a front cross bar extending perpendicularly from said front portion, and a pair of spaced-apart resilient side walls extending rearwardly from said front cross bar and perpendicularly from said front portion, each of said sidewalls including an opening therethrough, a rearwardly extending groove having a first end terminating at said opening and a second end opening at the rear of said sidewall, and a ramp at the area of said second end;

said front cross bar including a pair of spaced-apart rearwardly-extending ribs, and a plurality of beveled openings therethrough arranged in a predetermined pattern; and a contact strip including a plurality of contact chambers arranged in said predetermined pattern, a pair of recesses for receiving said ribs as said strip is moved forwardly across said floor towards and into engagement with said front cross bar, and a pair of laterally-extending projections for engaging respective ramps and traveling through said rearwardly-extending grooves and flexing said resilient sidewalls until received in said openings for snap-in retention of said contact strip.

4. The connecting plug of claim 3, and further comprising:

a saddle-shaped cable clamp cooperable with said floor rear portion including projections;

said rear portion including openings for receiving said cable clamp projections, a plurality of rearwardly-extending grooves between said openings, and a pair of lateral recesses; and a cap for covering said rear portion, said cap including a plate and a pair of resilient arms extending from said plate for receipt by said lateral recesses, each of said arms including a hook for snap-in retention, said hook engaging said floor adjacent said lateral recess.

5. A connecting plug comprising:

a multiple contact strip including a plurality of chambers for supporting a plurality of contacts in a predetermined pattern, and including a pair of oppositely-directed detents;

a receiving part including a front cross bar having a plurality of beveled openings therethrough in the same pattern as and for alignment with said chambers, a floor extending rearwardly from said front cross bar, and a pair of sidewalls extending rearwardly from said front cross bar and upwardly from said floor, whereby said front cross bar, said floor and said sidewalls form a cavity for receiving said contact strip, said sidewalls including respective openings for snap-in retention of said oppositely-directed detents;

a U-shaped cap including a member for extending over the rear portion of said floor after assembly of said contact strip with said receiving part, and a pair of arms extending from said member, said floor including a rear portion having a pair of lateral recesses therein, and each of said arms including a locking hook to be received in a respective lateral recess and engage said rear portion behind and adjacent said lateral recess in snap-in engagement.

6. The connecting plug of claim 5, wherein:

said rear portion comprises a plurality of rearwardly-extending longitudinal grooves.

7. The connecting plug of claim 6, wherein:

said rear portion includes a recessed surface and said longitudinal grooves are in said surface.

8. The connecting plug of claim 7, and further comprising:

a cable clamp including a semicircular portion for receiving a cable.

9. The connecting plug of claim 8, wherein:

said cable clamp comprises longitudinal grooves.

10. The connecting plug of claim 8, wherein:

said rear portion includes openings on each side of said longitudinal grooves for receiving a cable binding strap; and said cable clamp comprises openings for receiving the cable binding strap.

* * * * *